350-3.72 SR
11/3/87 XR 4,704,666

United States Patent [19]

Davis

[11] Patent Number: 4,704,666

[45] Date of Patent: Nov. 3, 1987

[54] ARTIFICIAL LIGHT SOURCE UTILIZING A HOLOGRAPHIC OPTICAL ELEMENT TO CONTROL RADIANT LIGHT

[76] Inventor: Charles S. Davis, 51 Wooster St., New York, N.Y. 10012

[21] Appl. No.: 897,295

[22] Filed: Aug. 15, 1986

[51] Int. Cl.[4] ..... F21V 7/00

[52] U.S. Cl. ..... 362/296; 350/3.72; 350/3.73

[58] Field of Search ..... 350/3.65, 3.7, 3.72, 350/3.73, 3.75, 3.77, 3.85; 362/296, 347

[56] References Cited

U.S. PATENT DOCUMENTS

| | | | |
|---|---|---|---|
| 2,220,145 | 11/1940 | Cooke | 362/332 X |
| 3,578,838 | 5/1971 | Hallock | 350/3.5 |
| 3,619,021 | 11/1971 | Biedermann et al. | 350/3.5 |
| 3,695,744 | 10/1972 | Clay | 350/3.5 |
| 3,708,217 | 1/1973 | McMahon | 350/3.5 |
| 3,737,212 | 6/1973 | Antonson et al. | 350/3.72 X |
| 3,909,111 | 9/1975 | Meyerhofer | 350/117 |
| 3,912,921 | 10/1975 | Howe et al. | 240/9.5 |
| 3,957,353 | 5/1976 | Fienup et al. | 350/3.5 X |
| 3,970,358 | 7/1976 | Kozma | 350/3.5 |
| 4,245,882 | 1/1981 | Chang | 350/3.72 |
| 4,432,044 | 2/1984 | Lautzenheiser | 362/223 |

FOREIGN PATENT DOCUMENTS

| | | | |
|---|---|---|---|
| 0117792 | 9/1984 | European Pat. Off. | 350/3.73 |
| 2,804,289 | 8/1978 | Fed. Rep. of Germany | 350/3.75 |
| 0006878 | 1/1982 | Japan | 350/3.75 |
| 0035701 | 2/1985 | Japan | 350/3.72 |

OTHER PUBLICATIONS

P. Hariharan, Optical Holography, 1984, pp. 41–62, 162–193, Principles, Techniques and Applications, Cambridge Studies in Modern Optics.

Herb Brody, Holography Creates New Breed of Optical Components, High Technology, Jul./Aug. 1981, Thin, Lightweight Holograms Mimic Lenses to Infiltrate Optical Systems.

IBM Technical Disclosure, Aug. 1967, Formation of Optical Elements by Holography, G. T. Sincerbox, vol. 10, No. 3.

R. T. Ingwall, H. L. Fielding, Proceedings of SPIE—The International Society for Optical Engineering, Applications of Holography, Jan. 21–23, 1985, Los Angeles, CA, Polaroid Corporation/vol. 523.

*Primary Examiner*—Stephen F. Husar

*Attorney, Agent, or Firm*—Brumbaugh, Graves, Donohue & Raymond

[57] ABSTRACT

Light sources having a holographic optical element incorporated in the envelope surrounding the radiation source provide efficient lighting of selected task area. Multilayer holographic optical elements may be employed in combination with known sources of white light such as incandescent filaments to form improved light bulbs, flourescent tubes and the like.

4 Claims, 4 Drawing Figures

ARTIFICIAL LIGHT SOURCE UTILIZING A HOLOGRAPHIC OPTICAL ELEMENT TO CONTROL RADIANT LIGHT

BACKGROUND OF THE INVENTION

The present invention relates to an artificial light source which incorporates a transmissive holographic optical element to provide improved control over the pattern of radiation from the source. Related inventions are described in my prior U.S. Pat. No. 4,536,833 and in my copending application Ser. Nos. 897,294, 897,296 and 897,292.

As used in this application, an artificial light source comprises an emissive material as a source of radiation, and an envelope surrounding the emissive material. Known artificial light sources within this definition include incandescent, fluorescent and high intensity discharge lamps. The term artificial light source as used in this application does not include fixtures which support the light source and facilitate the supply of power to the light source.

Current state of the art lighting and lamp design relies principally on the use of fixtures containing conventional reflectors and lenses to control the distribution of radiation. These fixtures, however, reduce the lighting efficiency of the light source since much of the radiation is reflected back into the fixture and lost as heat. Furthermore, heat build-up within the fixture can lead to a decrease in the life of the light source.

Some incandescent lamps, such as certain spot lights, may have a reflector and a conventional lens incorporated as integral parts of the light source. These lamps are still subject to substantial efficiency loss and heating, however, because of the nature of the conventional optical elements used. For example, the effect of a conventional lens on radiation depends entirely on the angle of incidence of the radiation. Radiation striking the lens over a certain range of angles will be diffracted roughly toward the task area. Outside of this range, however, radiation is either directed to a point outside the task area, or is reflected back into the lamp. The first of these effects leads to efficiency loss, the second to efficiency loss and heating.

SUMMARY OF THE INVENTION

It is an object of this invention to provide an artificial light source which provides improved lighting efficiency and reduced heat loss. This object is accomplished by incorporating a transmissive holographic optical element as a portion of the envelope surrounding a radiation source. The radiation source may be any emissive material, but can generally be considered as one of two types: an emissive point source, such as an incandescent filament; or an emissive continuous source, such as an emissive (fluorescent) phosphor, or an emissive gas.

DETAILED DESCRIPTION OF THE INVENTION

According to the invention, artificial light sources are formed having a transmissive holographic optical element incorporated as an integral part of the envelope surrounding the radiative material. This can be accomplished by using a holographic optical element as a portion of the envelope structure, i.e., by forming the envelope from the holographic element itself; or by placing a holographic overlay in intimate contact with the envelope surface.

Light sources useful in the invention include those based upon known radiative materials. For example, the light source can be based upon emissive point sources such as incandescent filaments, on emissive phosphors, such as those used in conventional fluorescent lighting or an emissive gas, such as used in high intensity discharge lamps. The radiation emitted by the radiation source is directed by the holographic optical element in a manner appropriate to the intended use for the light source.

Figure 1:
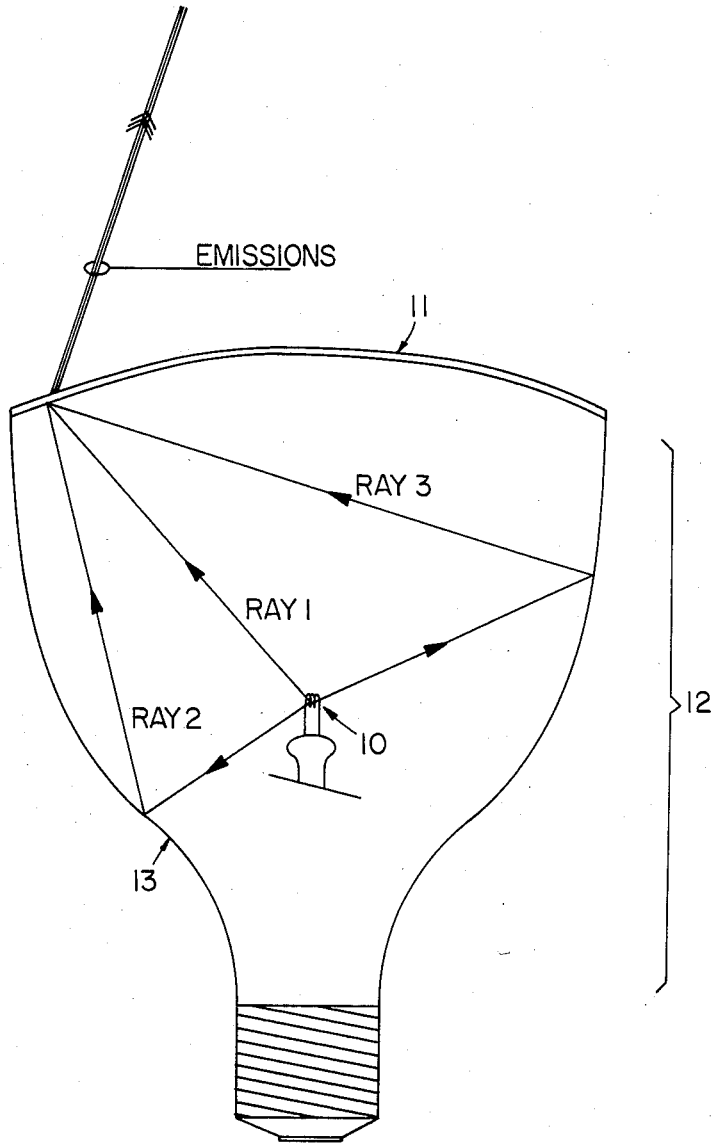
FIG. 1 is a cross-section of incandescent light source according to the invention.

For example, FIG. 1 shows an incandescent light source according to the invention in which light from a point source filament 10 strikes a holographic optical element 11 and is diffracted along a converging path. The degree of convergence, and thus the focal length, is determined by the holographic optical element which can even produce a collimated beam if desired.

The remainder of the envelope 12 is shaped to maximize reflection toward holographic optical element 11 such that the maximum amount of radiation is transmitted and diffracted by the holographic optical element. Advantageously, all or part of the remainder of the envelope 12 is coated with a reflective layer 13 to enhance reflection. This reflective layer can be formed by metallizing the surface of the envelope, or if desired can be accomplished using a reflective holographic optical element. In the latter case, the structure of the reflective hologram can largely take the place of envelope shaping to maximize transmission and diffraction by the transmissive holographic optical element 11.

Holographic optical elements can also be integrally incorporated into light sources based on emissive phosphors, such as fluorescent tubes. In this case, radiation is emitted in random directions from anywhere on the phosphorcoated surface of the tube. This provides uniform lighting in all directions, but in some circumstances it may be desireable to direct the light in only selected directions. For example, when fluorescent tubes are mounted against a surface, e.g., a ceiling or a wall, light directed at that surfafce is either partially wasted, or external reflectors must be used to redirect it in the desired direction.

Figure 2:
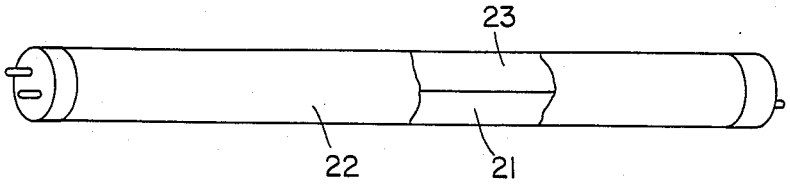
FIG. 2 is a cut away of a fluorescent tube according to the invention.

As shown in FIG. 2 a holographic optical element 21 can be incorporated as part of the envelope 22 of a fluorescent tube. The remaining portion of the envelope can be covered with a reflective layer 23 for example, a metallic coating or a reflective holographic optical element. The sockets for connecting the tube are then positioned such that the reflective layer 23 is oriented toward the wall or ceiling while light is directed by the transmissive holographic optical element to the desired area.

Figure 3:
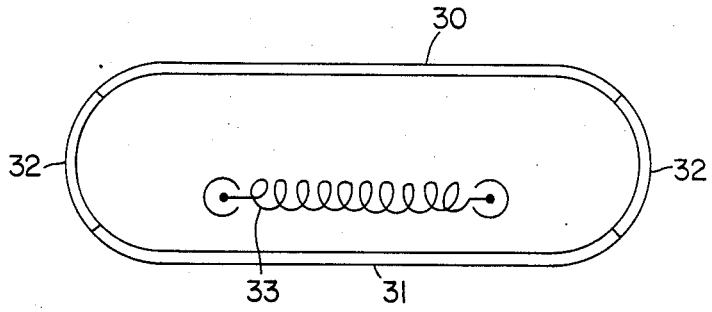
FIG. 3 is a cross-section of a fluorescent tube according to the invention.

Fluorescent tubes can also be formed having a plurality of holographic optical elements. For example, a fluorescent tube could be made as shown in FIG. 3 having an upper hologaphic optical element 30 and a lower holographic optical element 31 which direct light towards the ceiling and floor respectively. Advantageously, the upper element 30 will direct light at a broad spreading angle, e.g. 110° while the lower element directs light at a narrower spreading angle, e.g. 55°. The area between the upper and lower elements 30 and 31 can be coated with a non-transmissive material 32. The filament 33 may be located asymmetrically within the tube to provide preferential excitation of the phosphors on the lower surface.

Holographic optical elements are formed by the interaction of two light beams, a collimated reference beam and an object beam, on a photosensitive recording medium. The interference pattern formed by the interaction of the two beams is fixed in the recording medium to produce the holographic optical element. A collimated beam impinging on this holographic optical element will be diffracted to recreate the object beam.

Transmissive and reflective holographic optical elements for use in light fixtures according to the invention can be made using any known technique, such as those described in P. Hariharan, *Optical Holography,* Cambridge Univ. Press (1984), and in U.S. Pat. Nos. 3,695,744; 3,909,111; 3,957,353; 3,970,358; and 4,245,882 which are incorporated herein by reference. For example, the holographic optical elements can be formed as volume holograms by imaging in a light sensitive dichromate impregnated gelatin, a photosensitive polymerizable monomer such as the vinyl monomers in Polaroid's DMP-128 system, a silver halide photographic emulsion, or other solid light sensitive medium. Alternatively, the holographic elements used can be surface relief holograms formed by imaging onto a film of photoresist followed by chemical etching or by other suitable techniques. It is advantageous from a production standpoint to be able to duplicate holographic elements using a mold taken from the original, or by some other means that eliminates the need for repetitive imaging.

Figure 1A:
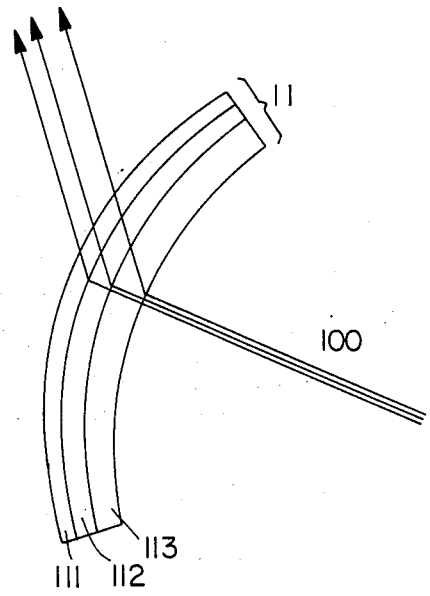
FIG. 1*a* shows an enlarged detail of a portion of the holographic optical element of FIG. 1.

The holographic optical elements may be multilayer structures. In this case, various layers of the holographic element are adapted to diffract a variety of wavelengths of light, and radiation of differing angles of incidence to provide efficient direction of the radiation from the light source. For example, FIG. 1*a* shows a multilayer structure in which various wavelengths of light in a polychromatic ray 100 are diffracted to the same angle by layers 111, 112 and 113 within the holographic optical element 11. The individual layers can in fact be adapted to a particular light source and light fixture configuration by forming the holographic element using wavelengths of light and incident angles which predominate for a given light source and fixture.

For most applications, the holographic optical elements used are selected to provide substantially achromatic illumination upon reconstruction. That is, if white light is used in reconstructing the image, a substantially white beam of light results. Some colored fringes may be acceptable under these circumstances so long as they do not interfere with the white light illumination of the task area. It is within the scope of this invention, however, to exploit the chromogenic properties of the holographic optical element to produce regions of colored illumination from a white light source. Such chromogenic light fixtures might have applications, for example, in decorative lighting or stage lighting.

I claim:

1. An artificial light source comprising a means for producing white light, and an envelope surrounding the means for producing white light, wherein at least a portion of the envelope comprises a transmissive holographic optical element such that light from the means for producing white light passing through the holographic optical element is directed to specific task area to provide substantially achromatic illumination of the task area.

2. An artificial light source according to claim 1, wherein the means for producing white light is selected from the group consisting of emissive filaments, emissive phosphors, and emissive gas.

3. An artificial light source according to claim 2, wherein the means for producing white light is an emissive filament, and wherein a further portion of the envelope is reflective on the surface of the envelope facing the point source such that light striking the reflective portion of envelope is reflected toward some other point on the envelope.

4. An artificial light source according to claim 3, wherein the reflective portion of the envelope is shaped such that light from the emissive filament is predominantly reflected toward the transmissive holographic optical element.

* * * * *